US008467556B2

(12) United States Patent
Shennib et al.

(10) Patent No.: US 8,467,556 B2
(45) Date of Patent: Jun. 18, 2013

(54) CANAL HEARING DEVICE WITH DISPOSABLE BATTERY MODULE

(75) Inventors: Adnan Shennib, Oakland, CA (US); Victor Valenzuela, San Jose, CA (US)

(73) Assignee: Ihear Medical, Inc., Oakland, CA (US)

( * ) Notice: Subject to any disclaimer, the term of this patent is extended or adjusted under 35 U.S.C. 154(b) by 306 days.

(21) Appl. No.: 12/878,926

(22) Filed: Sep. 9, 2010

(65) Prior Publication Data

US 2011/0058697 A1 Mar. 10, 2011

Related U.S. Application Data

(60) Provisional application No. 61/272,312, filed on Sep. 10, 2009.

(51) Int. Cl.
*H04R 25/00* (2006.01)

(52) U.S. Cl.
USPC ..... 381/324; 381/323; 381/328

(58) Field of Classification Search
USPC ..... 381/322–325, 328, 380; 181/129–130
See application file for complete search history.

(56) References Cited

U.S. PATENT DOCUMENTS

| | | | |
|---|---|---|---|
| 5,327,500 | A | 7/1994 | Campbell |
| 5,553,152 | A | 9/1996 | Newton |
| 5,645,074 | A | 7/1997 | Shennib et al. |
| 5,659,621 | A | 8/1997 | Newton |
| 5,701,348 | A | 12/1997 | Shennib et al. |
| 5,785,661 | A | 7/1998 | Shennib et al. |
| 6,137,889 | A | 10/2000 | Shennib et al. |
| 6,212,283 | B1 | 4/2001 | Fletcher et al. |
| 6,359,993 | B2 | 3/2002 | Brimhall |
| 6,367,578 | B1 | 4/2002 | Shoemaker |
| 6,473,513 | B1 | 10/2002 | Shennib et al. |
| 6,546,108 | B1 | 4/2003 | Shennib et al. |
| 6,724,902 | B1 | 4/2004 | Shennib et al. |
| 6,937,735 | B2 | 8/2005 | De Roo et al. |
| 6,940,988 | B1 | 9/2005 | Shennib et al. |
| 7,016,511 | B1 | 3/2006 | Shennib |
| 7,113,611 | B2 | 9/2006 | Leedom et al. |
| 7,215,789 | B2 | 5/2007 | Shennib et al. |

(Continued)

FOREIGN PATENT DOCUMENTS

| | | |
|---|---|---|
| WO | 99/07182 | 2/1999 |
| WO | WO 99/07182 A2 | 2/1999 |
| WO | WO 99/07182 A3 | 4/1999 |

OTHER PUBLICATIONS

"Lyric User Guide", http://www.phonak.com/content/dam/phonak/b2b/C_M_tools/Hearing_Instruments/Lyric/documents/02-gb/Userguide_Lyric_V8_GB_FINAL_WEb.pdf, Jul. 2010.

(Continued)

*Primary Examiner* — Tuan D Nguyen
(74) *Attorney, Agent, or Firm* — Dorsey & Whitney LLP

(57) ABSTRACT

A modular canal hearing aid assembly having a main module positioned in the ear canal and a disposable battery module laterally positioned in the ear canal. The main module incorporates the durable components of a hearing device including the receiver, microphone and electronics. The disposable battery module comprises consumable elements including battery and incoming sound port. The disposable battery module provides a unitary structure that is easier to handle, remove from the main module, and replace when any of the consumable elements is depleted or degraded. The canal hearing device assembly is generic in shape and provided with assorted seal tips for "instant fitting" without resorting to custom manufacturing.

36 Claims, 6 Drawing Sheets

U.S. PATENT DOCUMENTS

| | | | |
|---|---|---|---|
| 7,260,232 | B2 | 8/2007 | Shennib |
| 7,298,857 | B2 | 11/2007 | Shennib et al. |
| 7,310,426 | B2 | 12/2007 | Shennib et al. |
| 7,321,663 | B2 | 1/2008 | Olsen |
| 7,403,629 | B1 | 7/2008 | Aceti et al. |
| 7,424,123 | B2 | 9/2008 | Shennib et al. |
| 7,424,124 | B2 | 9/2008 | Shennib et al. |
| 7,580,537 | B2 | 8/2009 | Urso et al. |
| 7,664,282 | B2 | 2/2010 | Urso et al. |
| 8,155,361 | B2 | 4/2012 | Schindler |
| 8,184,842 | B2 | 5/2012 | Howard et al. |
| 2001/0008560 | A1 | 7/2001 | Stonikas et al. |
| 2002/0027996 | A1 | 3/2002 | Leedom et al. |
| 2002/0085728 | A1 | 7/2002 | Shennib et al. |
| 2005/0283263 | A1 | 12/2005 | Eaton et al. |
| 2006/0291683 | A1 | 12/2006 | Urso et al. |
| 2010/0040250 | A1 | 2/2010 | Gebert |
| 2010/0239112 | A1 | 9/2010 | Howard et al. |
| 2011/0058697 | A1 | 3/2011 | Shennib et al. |

OTHER PUBLICATIONS

"User Manual—2011", AMP Personal Audio Amplifiers.

International search report and written opinion dated Nov. 3, 2010 for PCT Application No. US2010/048299.

CANAL HEARING DEVICE WITH DISPOSABLE BATTERY MODULE

CROSS-REFERENCE

This application claims the priority benefit of U.S. Provisional Application Ser. No. 61/272,312, filed Sep. 10, 2009, which is incorporated herein by reference in its entirety for all purposes.

TECHNICAL FIELD

The present invention relates to hearing devices, and, more particularly, to hearing devices that are positioned in the ear canal for inconspicuous wear.

BACKGROUND OF THE INVENTION

Brief Description of Ear Canal Anatomy and Physiology

The ear canal 10 (FIGS. 1 & 2) is generally narrow and tortuous and is approximately 26 millimeters (mm) long from the canal aperture 11 to the tympanic membrane 15 (eardrum). The lateral-part 12 is referred to as the cartilaginous canal due to the underlying cartilaginous tissue 19. The cartilaginous region 12 of the ear canal 10 deforms in shape and moves in response to the mandibular (jaw) motions, which occur during talking, yawning, eating and also when sleeping over the ear. Hair and earwax (cerumen) are primarily present in this cartilaginous region 12. The medial part, proximal to the tympanic membrane 15, is rigid and referred to as the bony region 13 due to the underlying bone tissue 7. The skin in the bony region is very thin relative to the skin in the cartilaginous region and is far more sensitive to touch or pressure. The bony region has little tolerance to touch and pressure. A characteristic bend roughly occurring at the bony-cartilaginous junction 8 separates the cartilaginous region 12 and the bony region 13. The dimensions and contours of the ear canal vary significantly among individuals. There is a characteristic first and second bends generally occurring at the aperture area 11 and junction area 8, respectively. Leading into the ear canal is the concha 5 which aids in the collection of sound into the ear canal.

A cross-sectional view of the typical ear canal (not shown but described in details in cited references) reveals generally oval shape with a long diameter in the vertical axis and a short diameter in the horizontal axis. Canal dimensions vary significantly along the ear canal and among individuals. FIG. 2 shows an alternate view of the ear canal 10 (top-down) indicting the narrowness of the contoured ear canal and the challenge of placing and navigating a receiver assembly 41 in the bony region. Placement of a hearing device entirely in the bony region is problematic for most individuals even with the smallest miniature electroacoustic components available. Furthermore, access and manipulation of a miniature canal device becomes prohibitive when placed too deeply in the bony region. However, it is desirable to deliver sound in the bony region to achieve electroacoustic advantages including reduction of the acoustic occlusion effect, improved energy efficiency, reduced distortion, reduced receiver vibrations, and improved high frequency response. Unfortunately, placing a hearing device in the bony region is difficult due to space and canal contour constraints.

Physiological debris is primarily present in the cartilaginous region 12 of the ear canal, and includes cerumen (earwax), sweat, and oils produced by the various glands underneath the skin in the cartilaginous region. Debris in the ear canal is a major cause of damage to canal hearing devices resulting in frequent and costly repairs. Canal hearing devices on the market are mostly custom made with few exceptions. Generic canal devices currently have limited market acceptance due to poor fit, limited performance and reliability.

Several types of hearing losses affect millions of individuals. Hearing loss naturally occurs as we age beginning at higher frequencies (above 4000 Hz) and increasingly spreads to lower frequencies with age. It is estimated that over 30 million Americans suffer from hearing loss and the vast majority remain untreated due to the high cost of inconspicuous hearing devices and hassles of ownership.

The Limitations of Conventional Canal Hearing Devices.

The limitation of current canal hearing devices is well described in U.S. Pat. No. 6,473,513 and U.S. Pat. No. 6,137,889 incorporated herein by reference. These limitations include the well know occlusion effect (speaking into a barrel effect), dexterity limitation for placing a device deep in the ear canal, device size for fitting a miniature device into ear canals, particularly in small and contoured ones. A major limitation is the propensity of canal hearing aids (referring to both ITC and CIC types throughout the application) to feedback (whistle) when set at moderate volume settings or higher.

Current canal devices are mostly custom made requiring an impression of the ear canal to fabricate a custom shell and place electronic and electroacoustic components within. This process is notoriously inefficient leading to high cost, high rates of remake and return-for-credit. Because of their placement, primarily entirely in the cartilaginous region, custom canal devices are highly prone to contamination from ear canal debris. However, placement in the cartilaginous region as compared to the bony region has the distinct advantage of improved access and comfort of wear since the tissue there is more tolerant to frequent touch and pressure. This bony region is prone to damage and irritation when touched by any rigid part or when subjected to pressure.

It is a principal objective of the present invention to provide a canal hearing device that delivers sound within proximity to the eardrum while providing easy access to the hearing impaired user.

Another objective is to provide a cost effective generic design that can fit the majority of individuals without resorting to custom manufacturing.

A further objective of the invention is to provide acoustic sealing in the bony region for providing acoustic occlusion relief without placing a rigid structure therein.

A major objectives is to provide a new hearing aid formfactor that is inconspicuous to alleviate the stigma of hearing aid wear.

Another objective is to provide a more reliable miniature hearing aid design with predictable function and operation.

And finally, a major objective is to provide a miniature hearing aid design that is easy to maintain and does not require repair.

BRIEF SUMMARY OF THE INVENTION

The present invention provides a universal canal hearing device that is inconspicuous and delivers amplified sound in proximity to the eardrum. The canal hearing device comprises a main module and a disposable battery module comprising a sound port within. The main module fits primarily in the cartilaginous ear canal and incorporates durable components intended for long-term operation including the receiver (speaker), microphone and hearing aid electronics. The disposable battery module comprises consumable components that deplete or deteriorate within relatively a short period of time such as the battery and incoming sound port. The battery module also comprises an acoustically transparent debris filter to prevent water ingress and debris from reaching and contaminating the main module, particularly the microphone within.

The disposable battery module is removable and connects to the main module electrically, mechanically and acoustically for delivering power and incoming sound thereto. The unique modular design of the invention allows for a reliable, predictable, and cost effective maintenance of the canal hearing device by protecting expensive components designed for long term operation, while disposing periodically degradable elements. The unitary structure of the disposable battery assembly also acts as a handle to assist in manipulating the hearing device during insertion or removal.

In the preferred embodiments, the battery module assembly is shaped substantially in the shape of the battery cell integrated within. The battery module offers a more space efficient design by eliminating the battery compartment with a door as practiced in conventional custom hearing aids. The battery module is positioned laterally in the cartilaginous region terminating generally at the aperture for inconspicuous wear.

The main module connects medially to a seal tip positioned in the bony region in proximity to the eardrum. The seal tip assembly delivers sound via flexible narrow tubing and seals against the walls of the ear canal via soft compliant material concentrically positioned over the sound tubing. Sealing in the bony region minimizes the acoustic occlusion effect, which is highly objectionable by hearing aid users leading to discontinued use of a hearing aid. The sound tubing is relatively short (e.g. not exceeding 8 mm) and narrow (e.g., having a diameter of less than 2.5 mm) to allow the compliant seal tip to concentrically compress over. In the preferred embodiments, the seal tip provides as least 20 decibels of acoustic attenuation across the audiometric frequency range of 250-6000 Hz. The seal tip is removable and preferably disposable or washable.

The hearing device comprises a laterally retainer for providing centering contact with the ear canal in the cartilaginous region. The lateral retainer offers sound diversion for attenuated amplified sound away from the incoming sound port while providing ear canal aeration and occlusion relief.

The devices provided herein generally comprise universal generic modules with assorted seal tips for fitting a variety of ear canals without resorting to custom manufacturing. In the preferred embodiments, the battery module and the seal tip assembly are oriented at about 25° with the respect to the main module to fit within the characteristic contours of the ear canal.

A further aspect of the present invention is the ability to disconnect the battery module and connect a programming cable to the main module. The external programming cable connects to an external programming device, preferably a personal computer (PC) or a hand held electronic device. The programming cable delivers power, programming signals and test audio signals to the main module worn in the ear canal. This allow for an interactive fitting process involving hearing evaluation, prescription programming and post fitting evaluation. Connecting to a PC allows for connecting the hearing aid to the Internet for remote and web-enabled evaluation and fitting. The connection may also be made wirelessly using a wireless link.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

The above and still further objectives, features, aspects and attendant advantages of the present invention will become apparent from the following detailed description of certain preferred and alternate embodiments and method of manufacture and use thereof constituting the best mode presently contemplated of practicing the invention, when taken in conjunction with the accompanying drawings, in which.

DETAILED DESCRIPTION OF THE INVENTION

Figure 1:
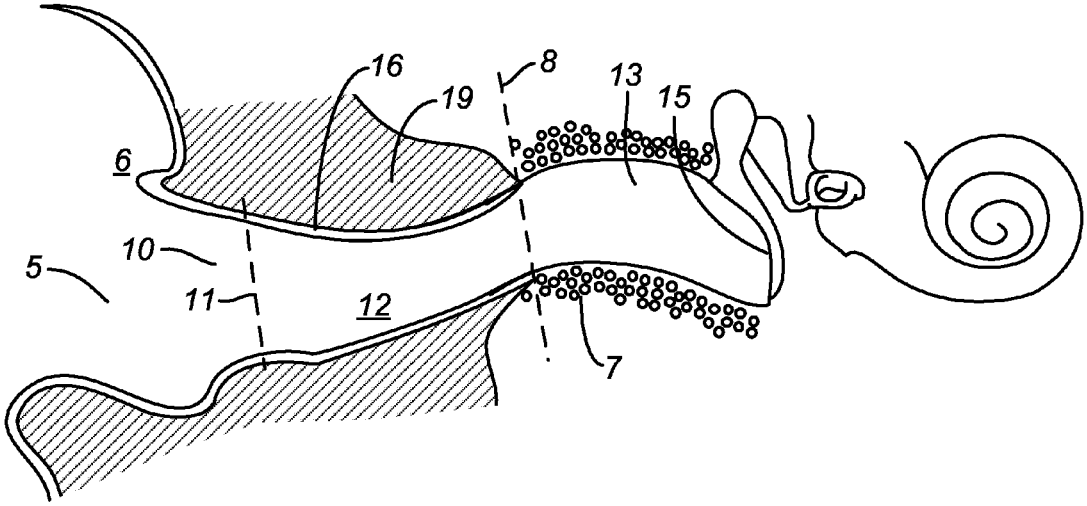
FIG. 1 is a side-frontal view of the external ear canal, described above.

The present invention provides a modular canal hearing aid for inconspicuous wear in the ear canal with sound delivered in close proximity to the eardrum. Exemplary embodiments of the modular canal hearing device 30 are described with reference to FIGS. 3-12.

The canal hearing device 30 comprises a main module 40 and disposable battery module 50 incorporating a sound port 51. The main module 40 fits entirely inside the ear canal past the aperture in the cartilaginous region 12. The main module incorporates components designed for durable prolonged operation including the receiver (speaker) 41 microphone 42 (shown in FIG. 6) and hearing aid electronics (not shown) such as sound processing integrated circuit. On the lateral end, the disposable battery module 50 incorporates non-durable elements that degrade in relatively short period of time such as the battery 52 (FIG. 5) and incoming sound port 51 which frequently gets soiled and clogged in conventional hearing aids. The sound port 51 incorporates an acoustically transparent debris barrier 56 which allows incoming sound 80 (FIG. 4) to enter and reach the main module 40 while filtering out debris that can damage components within the main module, particularly the microphone 42 which is acoustically connected and protected by the sound port 51 and debris barrier 56 when placed over it. Debris in the ear canal environment can be physiologic or non-physiologic and includes earwax, oils, water, particles, chlorine, soap residues, shampoo, etc.

The disposable removable battery module 50 is connected to the main module electrically, mechanically and acoustically for delivering power thereto and for delivering incoming sound to the microphone within the main module. The unique modular design of the invention allows for a reliable, predictable, and cost effective operation of the canal hearing device by protecting expensive components designed for years of operation, while providing periodic replacement of degradable elements. The unitary structure of the disposable battery assembly 50 is also easier to handle, replace and manipulate by the user alone, or with the main module 40 as a hearing aid assembly 30. This is particularly suited for the hearing impaired with limited dexterity and/or with poor vision. Replacing the integrated battery assembly 50 is far easier than replacing a battery cell as in conventional canal hearing aid designs.

Figure 9:
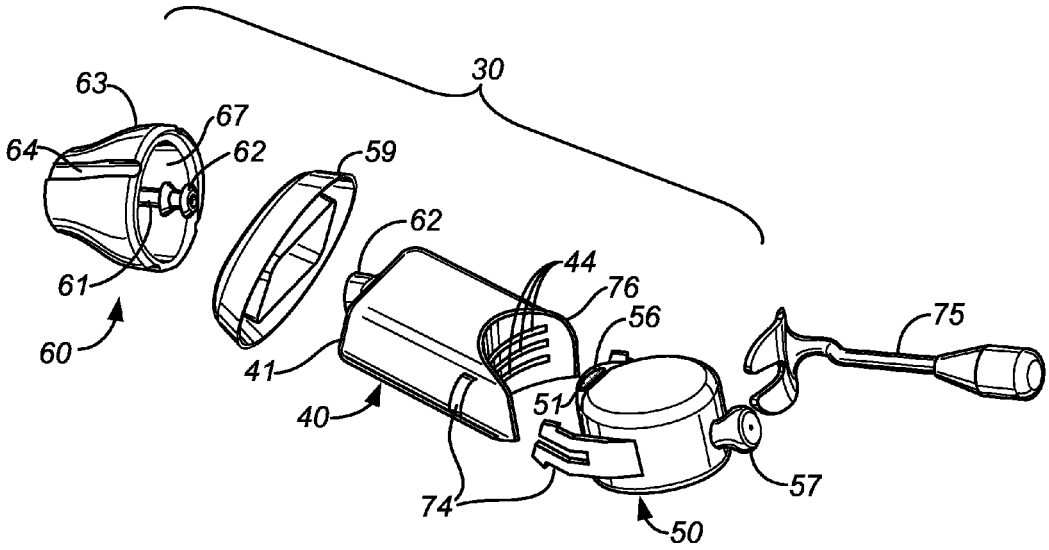
FIG. 9 shows an exploded view of the embedment of FIG. 8 with removal tool shown disengaged.

In the preferred embodiments, the battery module 50 is shaped substantially in the shape of the button-cell battery 52 (FIG. 5) housed within. The battery module further provides a knob-like structure for the assembled device 30 thus easier to handle during insertion into or removal from the ear canal. Grip grooves 54 further facilitates handling of the battery module 50 and the assembled device 30. The battery module 50 offers a more space efficient design by incorporating the battery in ultra thin-walled housing 53 instead of a battery compartment and door as in conventional canal hearing aids. The battery module 50 also incorporates an electromechanical connector 55, shown in the form of pin connector in FIG. 5 extending medially to mate with a receptacle (now shown for clarity) at the main module 40. The electrical connection may also be of contact strips 44 as shown in FIG. 9 employing snap mechanism 74 for the mechanical connection between the main module 40 and the battery module 50.

Figure 10:
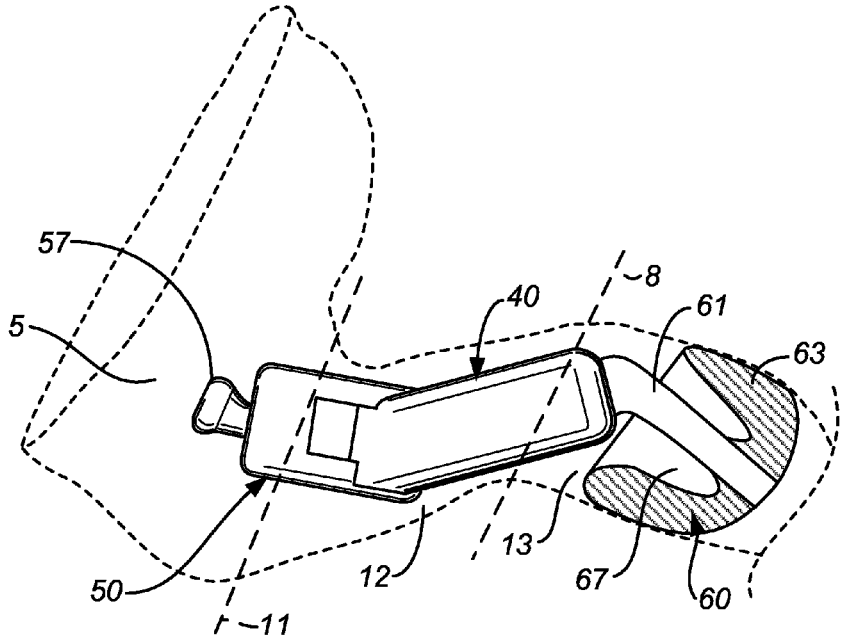
FIG. 10 shows an exemplary top-down surface model view for a subject with medium size ear canal, showing seal compressed moderately in the bony region.
Figure 11:
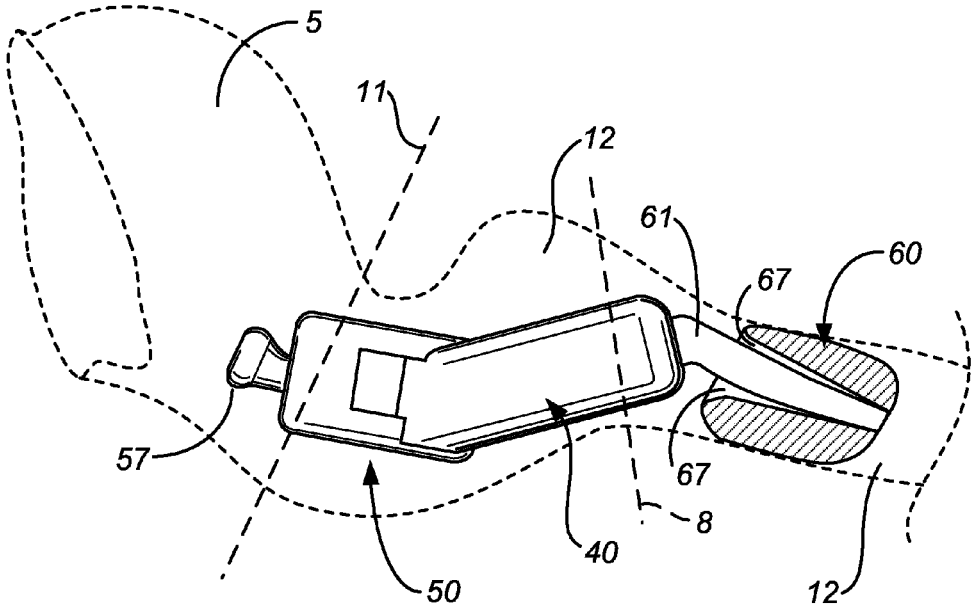
FIG. 11 shows an exemplary top-down surface model view for a subject's ear with small size ear canal, showing seal compressed severely in the bony region.

The main module 40 connects medially to a disposable retainer seal 60 for positioning in the bony region 13 in close proximity to the eardrum. The retainer seal assembly 60 delivers amplified sound to the eardrum via sound port tubing 61 and seals against the walls of the ear canal at the bony region via soft compliant seal tip 63 concentrically positioned over sound port tubing 61. Sealing in the bony region is important to minimize the occlusion effect, which is highly objectionable by hearing impaired individuals, particularly those with significant residual hearing in the low frequency range. Sound port tubing 61 is flexible and narrow with outside diameter not exceeding 2.5 mm to allow the compliant seal tip 63 to substantially compress, deform, and conform comfortably in the narrow and highly sensitive bony region 13 of the ear canal as shown in FIGS. 10 and 11. The flexibility of the seal assembly also allows for comfortable navigation into the contours of the ear canal. The present design eliminates placement of bulky rigid core structures inside a seal tip, such as in previous designs (for example U.S. Pat. Nos. 5,701,348 and 6,473,513) thus allowing a greater range of seal compression and compliance in the highly sensitive bony region of the ear canal, including small and narrow ears as shown in FIG. 11.

In some embodiments, the seal tip provides as least 20 decibels of acoustic attenuation across the audiometric frequency range of 250-6000 Hz. The seal tip assembly 60 is removable via tip connector 62 and is preferably made disposable and/or washable. Replacing retainer seal 60 periodically prevents contamination of the receiver 41 coupled thereto thus improves the longevity of the main module 40. Contamination of the speaker occurs when ear canal debris, particularly earwax, travels through a sound output port 61 reaching the receiver and damaging it. Therefore, periodic replacement of the retainer seal assembly 60 ensure continuous disposal of debris collected in sound port tubing 61. Seal tip channels 64 (FIGS. 3, 6, 8, 9) provide air venting for pressure equalization and for healthy aeration across the hearing device.

Figure 6:
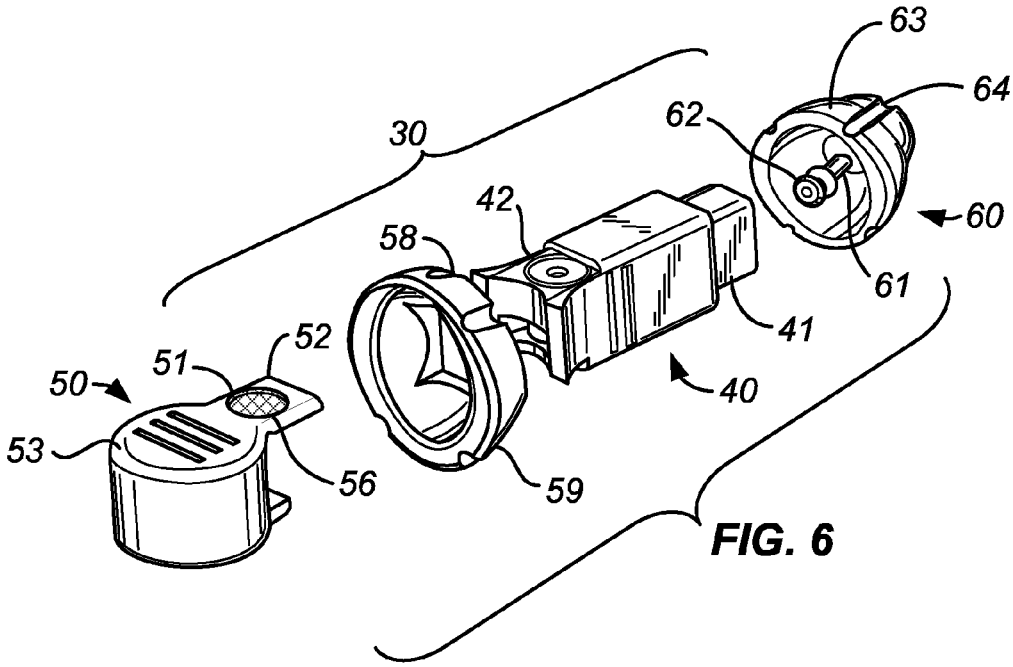
FIG. 6 is more an exploded view of an exemplary hearing device unassembled and exposing the microphone within the main module.

The canal hearing device 30 may incorporate laterally a centering retainer 59, about the area of the interface between battery module 50 and the main module 40. The lateral retainer 59 centers the device 30 in the cartilaginous region 12 of the ear canal (FIG. 4) and also functions to further isolate receiver sounds 68 from microphone sound port 51. The lateral retainer 59 is highly vented via relatively large channels 58 (FIGS. 3, 4, 6) or large vent hole (FIG. 8) for aeration of the ear canal and for providing acoustic occlusion relief. In the preferred embodiments, the retainer provides little or less than 15 decibels of attenuation across audiometric frequencies to provide a path of least resistance for "own-voice" that would otherwise be directed towards the eardrum. With this unique arrangement inside the rear canal, the medial retainer seal assembly 60 imposes a higher degree of acoustic attenuation thus preventing the undesirable acoustic occlusion effect. The lateral retainer 59 may be offered as a separate element, as shown in FIG. 6, or integrated (not shown) with the battery module for replacement therewith as a unitary structure. The retainer seal 60 and lateral retainer 59 provide retaining contact with the walls of the ear canal for secure placement within.

The seal tip 63 and retainer 59 are preferably made of compressible, soft and deformable material that is biocompatible such as medical grade polyurethane or silicone and may incorporate anti-microbial or anti-bacterial agents to minimize ear canal skin infections and damage to the ear canal.

The present invention minimizes costly damage and repair for the device by incorporating degradable elements in a single unitary disposable structure 50 that can be replaced periodically as needed. By employing a waterproof debris barrier 56, either over or under the sound port 51, the hearing device becomes water resistant, thus can be worn safely during water exposure when swimming or showering. Should the debris barrier 56 or the sound port 51 become soiled or damaged, such as after exposure to chlorinated water in pools, hair spray, shampoo, etc., the disposable battery module 50 is removed and replaced. Debris barrier 56 is preferably made of thin film or membrane that is acoustically transparent such as Emflon PTFE and Versapor™ manufactured by PALL corporation of Port Washington, N.Y. The debris barrier 56 should provide minimal acoustic attenuation of less than 2 decibels within the frequency range of 250-6,000 Hz.

The retainer seal assembly 60 delivers sound from the speaker 41 to the tympanic membrane in proximity efficiently and faithfully, particularly at high frequencies of the audible range. The seal tip 63 is placed entirely in the immobile bony region and within 6-10 mm from the tympanic membrane 15. The seal tip 63 is flexible and compresses freely over the air gap 67 between the sound conduction tube 61 and the seal tip 63. The flexibility and air gap also minimizes the transfer of motion to and from the main module 40. The seal tip 63 provides a level of articulation with respect to the longitudinal axis of the sound conduction tube 61 to further improve fit and comfort. The connector 62 of the sound conduction tube 61, shown as a straight snap-in in FIG. 9, can be made of an articulated joint as taught in the references cited herein. The sound tube 61 is relatively short and should not exceed 8 mm and preferably positioned in the range of 6-10 mm form the tympanic membrane to avoid inadvertent contact with the eardrum. Short sound tubing also minimizes the possibility of "jackknifing" when the seal tip is being inserted into the contoured ear canal.

Figure 4:
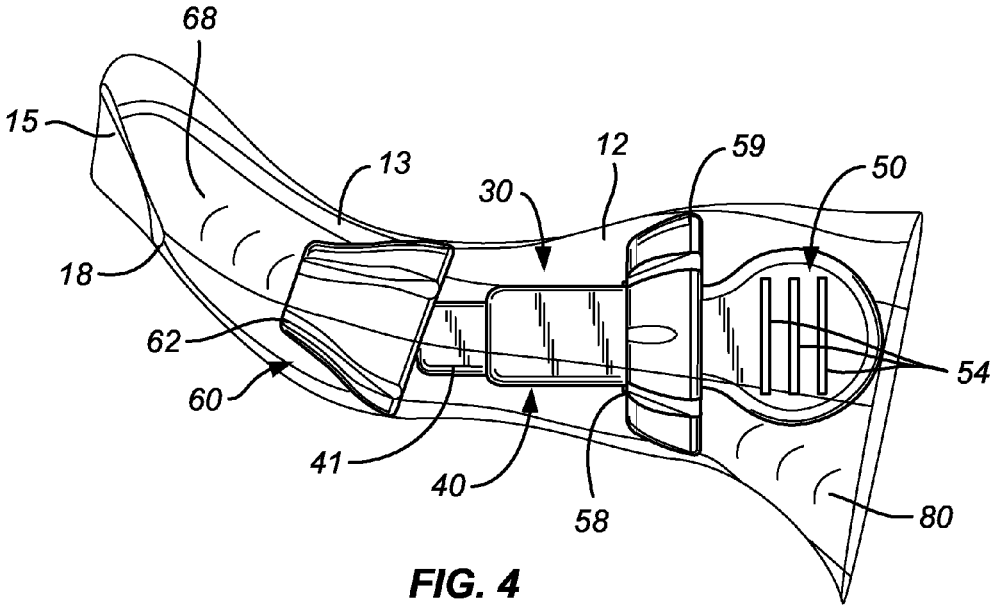
FIG. 4 is a view of an exemplary modular canal hearing device inside the ear canal.
Figure 5:
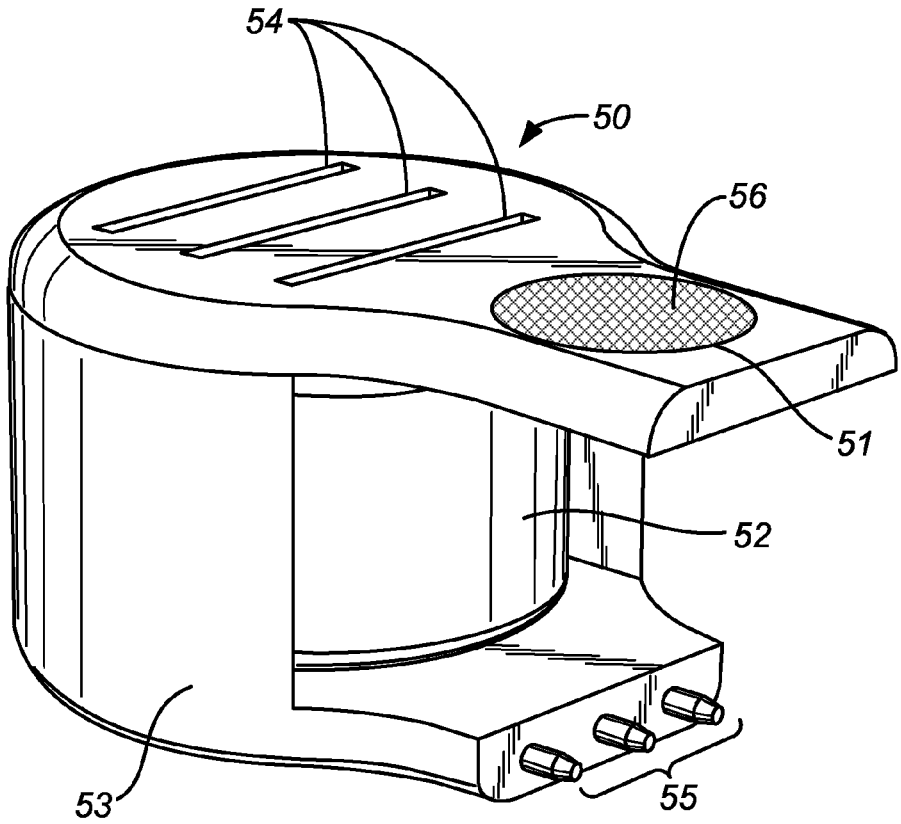
FIG. 5 a view of an exemplary disposable battery module showing the battery within, the sound port and electrical connector pins.

The hearing device 30 is designed for placement substantially in the ear canal for invisible wear therein as shown in FIGS. 4, 10 and 11. The battery module 50 is placed just at the aperture of the ear canal to allow the user easy access for insertion and removal. In the embodiments shown in FIGS. 8 & 9, grip knob 57 is provided on the lateral surface of the battery assembly 50 to facilitate grasping of the module 50, either by finger or a manual tool 75 with locking features such as in FIG. 8 with tool 75 shown engaged, and FIG. 9 (tool disengaged).

Figure 8:
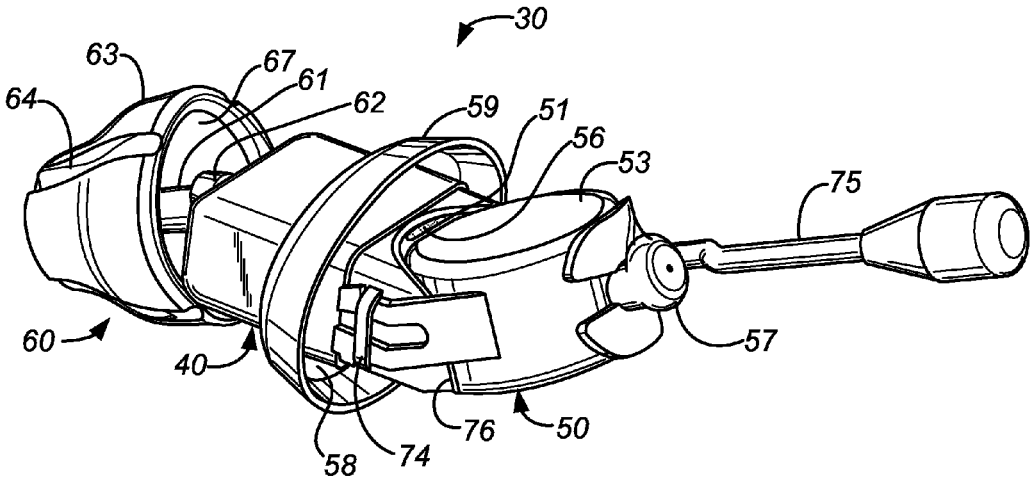
FIG. 8 shows an embedment of the hearing device with snap-in battery module having a knob structure and removal tool shown attached thereto. The figure also shows angular orientation of the battery module and seal tip with respect to the main module for fitting optimally into the characteristic bends of the ear canal.
Figure 12:
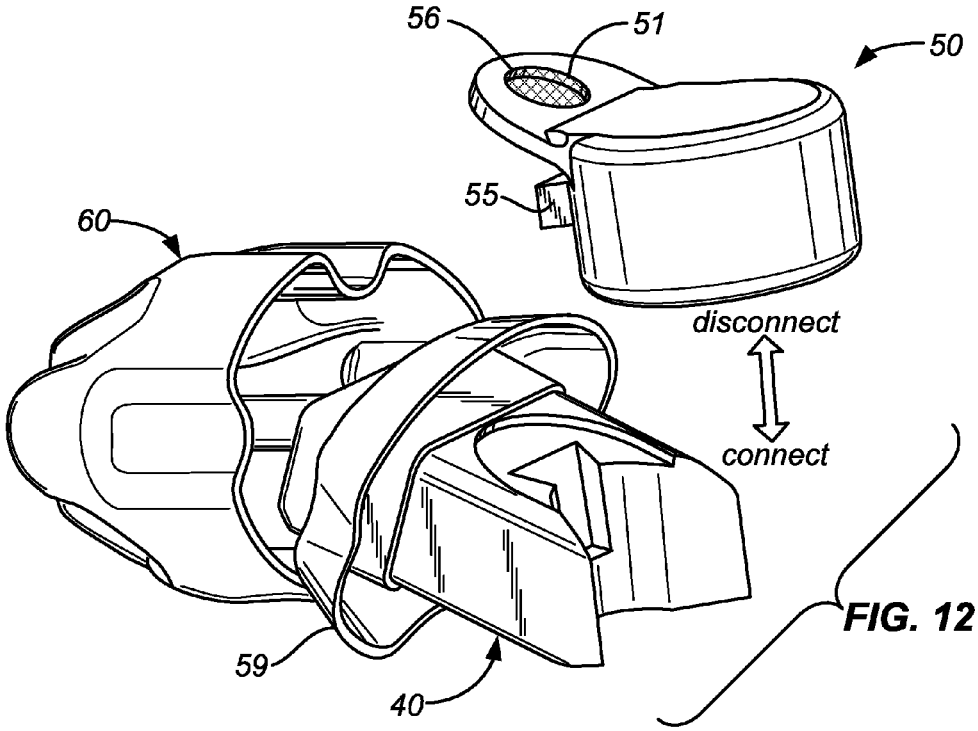
FIG. 12 shows an exemplary "dove-tail" engagement for the battery module.

The mechanical connection between the battery module 50 and the main module 40 is designed for sufficient bonding to prevent accidental disengagement. However, the battery module 50 is readily removable form the main module 40 upon appropriate force for replacement. An exemplary locking mechanism is a snap connection 74 as shown in FIGS. 8 & 9. Another attachment mechanism is the "dove-tail" sliding with sliding ledge 55 as shown in FIG. 12. Other attachment mechanisms (not shown) are conceivable and include, but are not limited to, the use of an appropriate tool in the form of a pin, screw driver ledge, or a coin.

In the preferred embodiments, the battery module 50 is replaced upon depletion, typically within 10-15 days of use. Other degradable parts incorporated within the battery module, such as debris barrier 56, will also be replaced thus ensuring reliable long-term operation of the hearing device.

In another embodiment (not shown), the canal hearing device 30 is designed with the battery module placed just outside the ear canal in the deeper portion of the concha area 5. This arrangement improves access for persons of limited dexterity such as those suffering from arthritis. Even in this embodiment, the hearing device is inconspicuously hidden behind the tragus (not shown) when viewed from the front or the side. The inconspicuous wear is enhanced by the use of dark colors for the battery module. In the preferred embodiment, black and/or dark gray colors were best in resembling the unoccluded ear canal cavity. In prototype experiments, black coloring of the battery module resulted in the most inconspicuous wear in the ear canal, even when the device was being looked at directly from close distance and from any angle.

The battery module 50 and main module 40 are designed in a generic shape thus eliminating custom manufacturing and allowing cost effective "instant fitting" method. The retainer seal assembly 60 and retainer 59 are also generic and offered in assorted sizes for fitting individual ear canals. In a preferred embodiment, the device is remotely controlled and programmed by wireless methods known in the art of hearing air control and programming. In one embodiment, a reed switch is incorporated in the main module for wireless remote control by a magnet placed in proximity to the ear canal. The battery module 50 may also comprise a rechargeable battery for periodic removal and charging by a charging station (not shown).

Electronic circuitry (not shown) incorporated in the main module 40 may comprise analog and digital circuitry for sound processing and control operations. The sound processing is preferably by a digital signal processing. Hearing aid electronics are well known in the art. A flexible circuit assembly (not shown) is typically employed for connecting various electronic components including the microphone, switches, receiver, and wireless control elements. The mechanical interface between the battery module 50 and the main module 40 preferably provide tight sealing to prevent water ingress into the interface. This can be accomplished by providing an O-ring 76 at the interface as shown in FIGS. 8 and 9. The O-ring 76 may be an integral part of the battery assembly 50 or the main module 40 as show in the FIG. 9.

Venting channels 64 are provided on the outer surface of seal tip 63 for providing pressure venting and aeration across the retainer seal assembly 60. Minimal venting is required across the retainer seal assembly 60 in the bony region since sweating glands and moisture are present primarily in the cartilaginous region 13. In the embodiments shown in FIGS. 3, 4, 6, 8 & 9, venting channels 64 are provided as part of the outer structure thus eliminating the need for providing interior venting (i.e, tubing) typically employed in conventional and prior art hearing aid design. Vent channels 58 are also shown as part of the outer structure in FIGS. 3, 4 and 6, but part of the interior structure as a vent hole 58 in FIG. 8.

Figure 7:
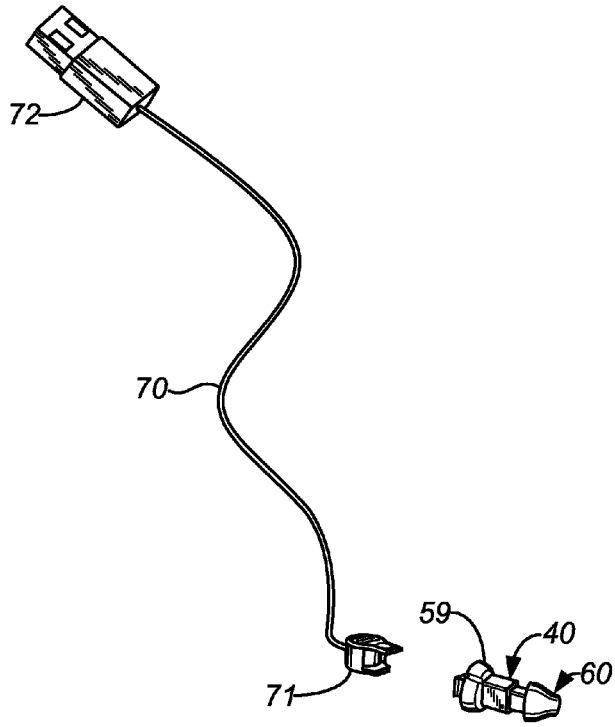
FIG. 7 is a view of an exemplary programming cable having an interface plug for replacing the battery module and connecting the main module directly to a USB port of a personal computer.

The hearing device of the present invention is designed for water-resistance to withstand moisture and occasional water exposure while in the ear canal. However, should the battery module 50 becomes damaged, plugged by earwax, or power depleted, it can be readily replaced while preserving the relatively more expensive main module 40. In the preferred embodiments, the battery module and the seal tip assembly are oriented at an angle with the respect to the main module to fit in the characteristic contours of the ear canal, more specifically into the first and second bends thereof. The angle is generally in the range of 20-35°, preferably about 25°, In another aspect of the present invention shown in FIG. 7, the hearing device 30 is connectable to an external fitting device via a programming cable assembly 70 having a connector 71 that plugs into the main module 40 when the battery module 50 is removed. In some embodiments, the fitting cable assembly 70 connects to a personal computer (not shown) via standard PC interface such as a USB port plug 72 as shown in FIG. 7. The programming cable assembly 70 provides power from the USB port. In some embodiments, the USB interface 70 also provides audio signals to the main module 40 for testing and evaluation of hearing and for programming the prescription, and for aided evaluation. In some embodiments, the hearing evaluation may be performed by presenting test signals or commands to the main module, to produce tones at various frequencies while the device is connected to the PC via cable assembly 70. The fitting system software, which can be web-enabled, interactively determines hearing aid prescription based on the test results. The prescription is then programmed into the main module accordingly. It should be understood that the term "PC" should not be limited to personal computer but rather used herein for any device capable of running a software application and may be connected to the Internet. This includes, but is not limited to, cell phones, tablet computers, notebooks, netbook, pocket computers, personal digital assistant (PDA), and the like.

Using the cable assembly 70 shown in FIG. 7, the fitting prescription for an individual can be determined, validated and fine-tuned by presenting various test signals including, but not limited to, speech, words, music, noises, environmental sounds, and the like. PC-based fitting is readily adapted to Internet applications. For example, the user can connect the main module to the PC via web-based application and the fitting process can be performed automatically or with the assistance of a hearing professional present at a remote location. It is well within the scope of the present invention to present a fitting process partially or entirely via the Internet.

EXAMPLES

The following experiments were conducted to validate a universal design for the invented modular hearing device. Ear canal data was obtained from ear impressions, surface models, as well as subjective responses from human subjects wearing prototypes.

Experiment-A

Impressions of ear canals were obtained from 7 adults ranging in age from 19 to 67. Cross section measurements of the ear canal impressions were made for the long diameter ($D_L$) and short diameter ($D_S$) in 3 different regions of the ear canal; the cartilaginous region (C), the bony region (B) and bony-cartilaginous junction region (J). Impression material was injected in the ear canal up to approximately 6-8 mm from the tympanic membrane, using standard material and impression techniques. The impression was removed from the ear canal after curing and dimensional measurements were taken. The 7 impressions were also laser scanned to obtain 3D surface models. Results of right ear are tabulated below.

TABLE 1

Right ear canal dimensions

| | C Region in mm | | BC in mm | | B Region in mm | |
|---|---|---|---|---|---|---|
| Subject | $D_L$ | $D_S$ | $D_L$ | $D_S$ | $D_L$ | $D_S$ |
| 1 | 12.5 | 7.3 | 11.4 | 6.6 | 10.8 | 5.4 |
| 2 | 13.0 | 9.1 | 9.7 | 5.9 | 10.0 | 5.2 |
| 3 | 8.9 | 5.5 | 9.0 | 5.0 | 10.6 | 7.1 |
| 4 | 12.9 | 6.1 | 11.3 | 6.6 | 9.2 | 6.6 |
| 5 | 8.0 | 6.0 | 8.6 | 6.9 | 6.1 | 4.2 |
| 6 | 8.6 | 6.7 | 8.3 | 8.0 | 7.4 | 5.28 |
| 7 | 9.4 | 5.2 | 8.7 | 5.8 | 6.9 | 3.8 |
| Average | 10.5 | 6.6 | 9.6 | 6.4 | 8.7 | 5.4 |

Results and Analysis of Experiment A

Figure 2:
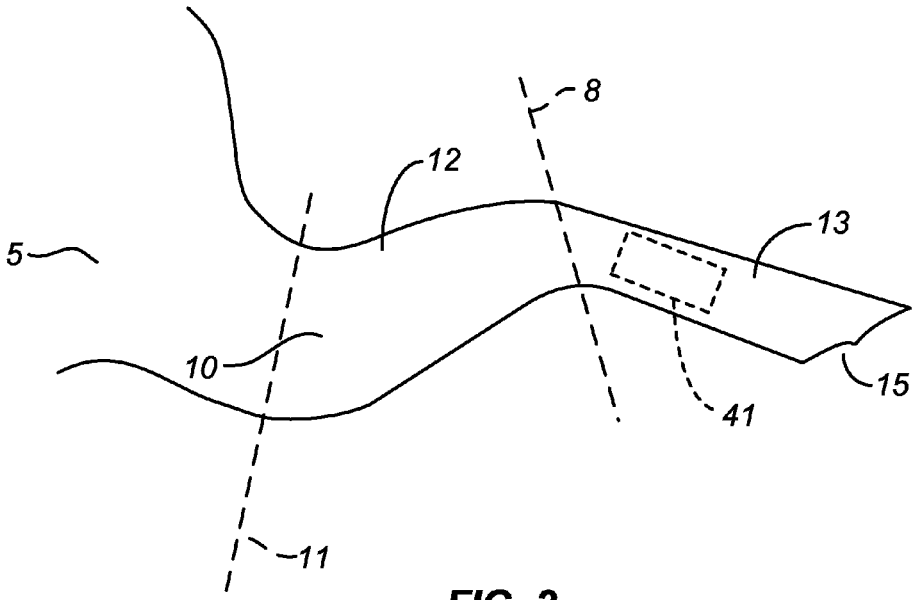
FIG. 2 is a top-down view of the ear canal showing the first and second bends, the narrow bony region and the challenge of fitting a receiver therein.
Figure 3:
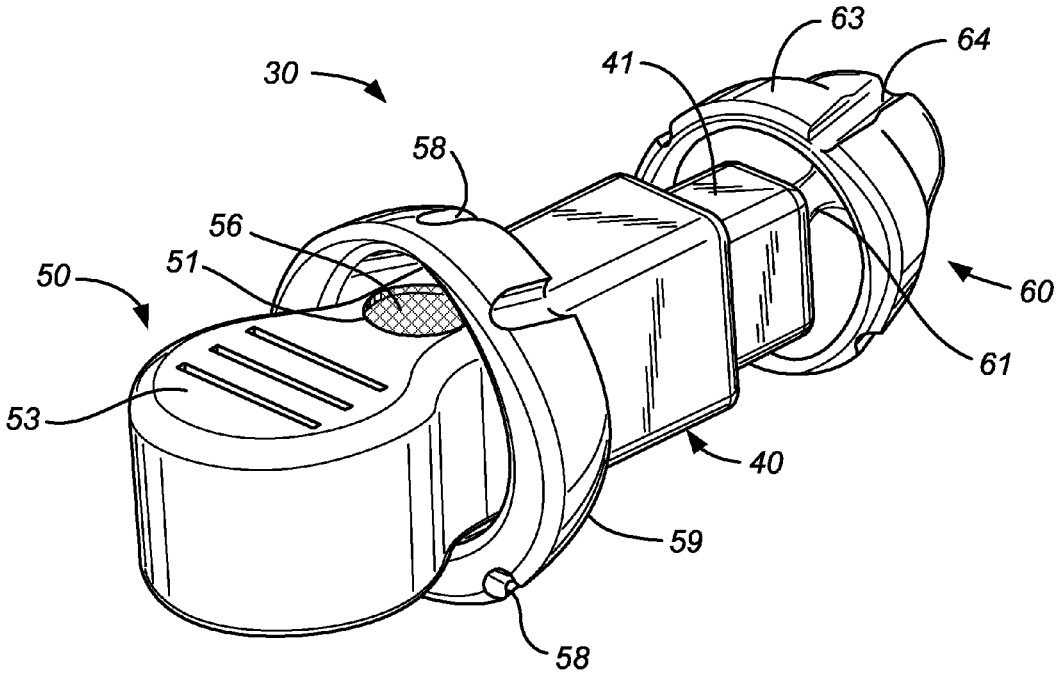
FIG. 3 is a view of an exemplary assembled modular canal hearing device.

Ear canal diameters vary considerably from as little as 3.8 mm in the short diameter of the bony region to as much as 13 mm in the long diameter of the cartilaginous region. Although smaller and larger ear canals do exist the subject population fairly represented the general population according to the experience of the inventors. The ratio of long to short diameter in each region was approximately 1.6 which is consistent with other data. The short diameter in the bony region averaged 5.4 mm highlighting the challenge of fitting a receiver assembly 41 (FIG. 2). Two subjects had particularly narrow ear canals with less than 5 mm diameter in the bony region.

Experiment B

In this experiment, it was attempted to place the smallest receiver components available on the market within the bony region. To achieve a universal fit, according to the goals of the invention, a compliant foam seal was concentrically placed over the receiver portion. Miniature receiver model FK-3451 manufactured by Knowles Electronics was used for the experiment. The receiver approximate dimensions were 2.0×2.7 mm×5 mm in length. The placement fitting test was performed on actual subjects and validated by 3D surface models obtained from ear canal impressions. The foam seal was made of polyurethane to allow for compression and sealing along the walls of the ear canal. The acoustic seal had a thickness of approximately 1.5 mm, thus consuming approximately 3 mm across the ear canal prior to any compression.

Results and Analysis of Experiment B

Placement of a receiver assembly into the bony region was problematic for all 7 subjects. Two of the 7 subjects could not tolerate insertion at any depth into the bony region. The difficulty in fitting standard miniature electroacoustic components in the bony region is largely due to dimension and structural issues including; girth of the receiver/seal combination; length of the receiver/electronic assembly; contours of the ear canal; non-compliant nature of electroacoustic components, and; non-compliant nature of the bony region. A universal hearing aid design with receiver placement in the bony region would have a high rate of contraindication in the general population, particularly for self-insertion.

Experiment C

In this experiment, the embodiment shown in FIG. 8 was tested with the same 7 subjects. The seal design without the receiver allowed for substantial concentric compression as shown in FIGS. 10 and 11. The seal tip, made of a compliant foam material, was placed over flexible sound conduction tube approximately 5 mm in length and 1.5 mm in diameter. There was an air gap 67 between the seal tip 63 and the sound conducting tube 61, as shown in FIGS. 8, 10 and 11. The seal tip was approximately 11 mm in diameter but allowed to compress considerably over the air gap and the sound tube within. The battery assembly 50 was disk shaped, approximately 6 mm in diameter and 3.5 mm in height, with an angle of about 25° with respect to the main module. The seal assembly 60 also had about 25° angle with respect the main module, in the reverse direction as shown in FIGS. 8-12. The angled design mimicked the characteristic natural contours of the ear canal. Retention of the device against lateral migration was also tested.

Results and Analysis of Experiment C

The universal device was inserted in the right ear canal of all 7 subjects. The angle design allowed for deep fitting with the seal assembly placed well into the bony region as shown in FIGS. 10 & 11. The bulky size of the main module and the bends of the hearing device provided a natural stop against deeper insertion and accidental contact with the eardrum.

All 7 subjects reported comfort of wearing. The universal device was virtually "invisible" even when looked at directly from close distance and at any angle. This was particularly the case when the battery module was colored black which camouflaged the battery module as the ear cavity.

Conclusion of Experiments A-C

The ear canal in the bony region is rigid, non-compliant and extremely sensitive to touch and pressure. Inserting a retainer seal into the bony region of the ear canal for the general population is possible by the design of soft compliant compressible material over an air-gap and a flexible core of less than 2.5 mm in diameter. Rigid bulky components are more suited for fitting in the cartilaginous region within a main module and with a battery module laterally connected at an angle of approximately 25°. The device was inconspicuous for all subjects and actually invisible for most, particularly when the battery module was colored black. The retainer seal 60 and lateral retainer 59 provided secure retention of the device in the ear canal.

Although a presently contemplated best mode of practicing the invention has been described herein, it will be recognized by those skilled in the art to which the invention pertains from a consideration of the foregoing description of presently preferred and alternate embodiments and methods of fabrication and use thereof, that variations and modifications of the exemplary embodiments and methods may be made without departing from the true spirit and scope of the invention. Thus, the above-described embodiments of the invention should not be viewed as exhaustive or as limiting the invention to the precise configurations or techniques disclosed. Rather, it is intended that the invention shall be limited only by the appended claims and the rules and principles of applicable law.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. A modular canal hearing device, comprising:

a main module comprising durable elements including a microphone for receiving incoming sound, an amplifier circuit for amplifying electrical signal representative of incoming sound, and a receiver for delivering amplified sound to the eardrum;

a battery module adapted for being laterally positioned in the ear, the battery module comprising a battery and a sound port incorporating a debris barrier, the sound port configured for receiving incoming sound and delivering said incoming sound to said microphone within said main module when said battery module is connected to said main module forming the modular hearing device; and wherein said battery module is removably connected electrically, mechanically and acoustically to said main module for operation of the modular hearing device in the ear canal and is removable from said main module.

2. The hearing device of claim 1, further comprising a seal assembly connected medially to said main module, wherein said seal assembly is adapted for being positioned in the ear canal in proximity to the eardrum, and wherein said seal assembly comprises a compliant seal tip for compression and conforming against walls of the ear canal to acoustically seal and prevent feedback.

3. The hearing device of claim 2, wherein said seal assembly is removable from said main module.

4. The hearing device of claim 2, wherein said seal assembly is of one of assorted sizes to fit a variety of ear canals in the bony region.

5. The hearing device of claim 2, wherein said seal assembly comprises a sound conduction tube.

6. The hearing device of claim 2, wherein said seal tip comprises compliant polyurethane material.

7. The hearing device of claim 2, wherein said seal tip comprises medical grade silicone material.

8. The hearing device of claim 1, further comprising a lateral retainer concentrically positioned over the hearing device about an area of interface between the main module and the battery module.

9. The hearing device of claim 8, wherein said lateral retainer is removable from said hearing device.

10. The hearing device of claim 8, wherein said lateral retainer is integrated within said battery module for disposal thereof along with said battery module.

11. The hearing device of claim 1, wherein said debris barrier acoustically transparent and made of air permeable film or membrane.

12. The hearing device of claim 1, wherein said debris barrier is resistant to water ingress.

13. The hearing device of claim 1, wherein said debris barrier imposes acoustic loss not exceeding 2 dB at any frequency within the range between 250 and 6,000 Hz.

14. The hearing device of claim 1, wherein said hearing device is programmable.

15. The hearing device of claim 1, wherein said battery module and main module are formed of generic shape thus not requiring custom manufacturing for fitting an individual.

16. The hearing device of claim 1, wherein said battery module is oriented at an angle between 20°-35° with respect to the main module.

17. The hearing device of claim 1, further comprising means to remove said battery module and replace with a programming cable assembly, wherein said programming cable is configured to provide power and programming signal to said main module.

18. The hearing device of claim 17, wherein said programming cable assembly is further configured to deliver audio signal to said hearing device.

19. The hearing device of claim 1, further comprising means for connecting to the Internet for performing a fitting process over the Internet.

20. The hearing device of claim 1, wherein said battery module is formed substantially in the shape of the battery cell housed within.

21. The hearing device of claim 1, wherein placement of said battery module at an aperture area of the ear canal results in an inconspicuous accessible wear in the ear canal.

22. The hearing device of claim 1, wherein said battery module is colored in black or dark color resembling the dark cavity of the unoccluded ear canal.

23. The hearing device of claim 1, wherein said battery module is further adapted for mechanically coupling the battery module to a tool to facilitate insertion or removal of the assembled hearing device.

24. The modular hearing device of claim 1, wherein said battery is rechargeable.

25. A disposable battery module for connecting and forming a canal hearing aid assembly, wherein said disposable battery module comprises:

a power source;

a sound port for receiving incoming sound and delivering said incoming sound to a microphone port;

an acoustically transparent debris barrier for preventing contamination of components connected to said disposable battery module;

a connector system for electrically, mechanically and acoustically coupling said disposable battery module within said canal hearing aid assembly; and wherein said disposable battery module is removable from said canal hearing aid assembly for disposal and replacement of said disposable battery module.

26. A modular canal hearing aid assembly for wear into the ear canal comprising:

a battery module configured to be laterally positioned in the ear and having a structure for electrically, mechanically and acoustically connecting to a main module, said main module containing a microphone therewithin, wherein said battery module comprises a battery, a sound port for receiving incoming sound and delivering said incoming sound to a microphone port, and an acoustically transparent barrier, and wherein said battery module is oriented at an angle with respect to the main module;

wherein said battery module is removable from said main module.

27. The disposable module of claim 26, wherein said power source is rechargeable.

28. A method of fitting a hearing aid assembly, the method comprising:

removing a battery module comprising a battery and a sound port incorporating a debris barrier from a main module comprising a microphone, receiver and programmable electronics;

connecting a programming cable assembly to said main module;

inserting the main module in the ear of an individual while said main module is connected to said programming cable assembly;

delivering power and programming signal to said main module via said programming cable;

removing said programming cable assembly from said main module;

connecting a battery module to said main module forming a canal hearing aid assembly; and inserting said hearing aid assembly into the ear canal of the individual.

29. The method of claim 28 further comprising delivering audio signal to said main module via said programming cable when connected thereto and said main module is in the ear canal.

30. The method of claim 28 further comprising connecting said hearing aid assembly to the Internet via programming cable.

31. The method of claim 28, wherein said battery is rechargeable.

32. A method of wearing a canal hearing device, the method comprising:

providing a main module and a battery module, wherein said battery module is removable from said main module, and wherein said battery module comprises a battery and a sound port for receiving incoming sound, the sound port incorporating a debris barrier;

connecting said battery module to said main module to form a canal hearing aid assembly; and inserting said canal hearing aid assembly into the ear canal of an individual.

33. The method of claim 32, wherein said battery module further comprises an acoustically transparent barrier at the sound port.

34. The method of claim 32 further comprising prior to inserting said canal hearing aid assembly into the ear canal, connecting a seal assembly including a compliant seal tip medially to said main module.

35. The method of claim 32, wherein said battery is rechargeable.

36. A modular canal hearing device, comprising:

a main module including a microphone for receiving incoming sound, an amplifier circuit for amplifying electrical signal representative of incoming sound, and a receiver for delivering amplified sound to the eardrum; and a battery module adapted for being laterally positioned in the ear, the battery module including a battery and a sound port configured for receiving incoming sound and delivering said incoming sound to said microphone within said main module when said battery module is connected to said main module forming the modular hearing device, wherein said battery is lateral to said sound port, and wherein said battery module is removably connected electrically, mechanically and acoustically to said main module for operation of the modular hearing device in the ear canal.

* * * * *